US006945201B2

(12) United States Patent
Taxon et al.

(10) Patent No.: US 6,945,201 B2
(45) Date of Patent: Sep. 20, 2005

(54) POSITIVE CRANKCASE VENTILATION IN AN ENGINE HAVING A CYCLICALLY VARYING CRANKCASE VOLUME

(75) Inventors: Morse N Taxon, Oak Park, MI (US); Donald D Anderson, Ann Arbor, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/758,310

(22) Filed: Jan. 15, 2004

(65) Prior Publication Data

US 2005/0155562 A1 Jul. 21, 2005

(51) Int. Cl.[7] ..... F01M 13/00
(52) U.S. Cl. ..... 123/41.86
(58) Field of Search ..... 123/41.86, 572, 123/573, 574

(56) References Cited

U.S. PATENT DOCUMENTS 5,881,686 A * 3/1999 Schmidt ..... 123/41.86
6,807,958 B2 * 10/2004 Kabat et al. ..... 123/574

* cited by examiner

*Primary Examiner*—Henry C. Yuen
*Assistant Examiner*—Hyder Ali
(74) *Attorney, Agent, or Firm*—Thomas A. Jurecko

(57) ABSTRACT

A method and apparatus providing positive crankcase ventilation, for the crankcase of an four-stroke engine having one or more reciprocating pistons exposed on a bottom side thereof to the crankcase, whereby the crankcase and bottom side of the one or more reciprocating pistons define a crankcase volume that varies cyclically with reciprocation of the one or more pistons. The cyclically varying volume of the crankcase, resulting from reciprocation of the one or more pistons, is used for generating a flow of air through the crankcase. The flow of air through the crankcase varies substantially in direct proportion to engine speed. An inlet control device and an outlet control device are attached to the crankcase, for controlling the flow of air through the crankcase.

13 Claims, 4 Drawing Sheets

TDC

BDC

TDC

POSITIVE CRANKCASE VENTILATION IN AN ENGINE HAVING A CYCLICALLY VARYING CRANKCASE VOLUME

TECHNICAL FIELD OF THE INVENTION

This invention relates to positive crankcase ventilation in an engine, and more particularly to positive crankcase ventilation in reciprocating piston engines wherein reciprocation of the pistons causes a cyclical variation in crankcase volume.

BACKGROUND OF THE INVENTION

Government evaporative emissions regulations require that engines be configured to prevent blow-by gasses, fumes, vapors, and other potential air pollutants in the engine crankcase from being released to the atmosphere. To comply with these regulations, engines typically provide some form of positive crankcase ventilation (PCV) system.

In addition to being potential atmospheric pollutants, Nitrous Oxide ($NO_x$) in blow-by gasses also degrades oil in the crankcase, resulting in shorter usable life of the oil. This accelerated degradation of the oil can reduce engine durability, and negatively impacts the environment by requiring that the oil be changed, and hopefully recycled, more often than would be the case if the level of $NO_x$ could be reduced. It is desirable, in fact, to provide more crankcase ventilation than is required for meeting government evaporative emissions regulations, in order to promote longer oil and engine life. As will be understood from the discussion below, existing PCV systems are often incapable of providing as much crankcase ventilation as is desired.

In a typical PCV system, engine vacuum in the intake manifold is utilized for drawing a flow of air through the crankcase, to entrain blow-by gasses, fumes, vapors, and other potential air pollutants in the engine crankcase in the flow of air through the crankcase. The air with entrained potential pollutants from the crankcase is then directed by the PCV system into engine air intake, to be re-burned during the combustion process in the engine.

As is well known in the art, engine vacuum is generated in a typical engine as a result of the position of a throttle plate in a throttle body or carburetor, and varies in an inverse relationship to the power output of the engine. The power produced is a function of both the torque that the engine is producing and the speed at which the engine is running. At any time that the engine is producing output power, the highest engine vacuum occurs when the engine is operating at an idle condition, with the throttle plate nearly closed, and with the engine running essentially unloaded. Even higher engine vacuums can occur when the throttle plate is at its lowest opening, and the engine is being motored by an inertia load, and receiving rather than producing power. This condition occurs during operations such as engine braking in a vehicle. The lowest engine vacuum occurs when the engine is operating at a wide-open throttle (WOT) condition and producing maximum power. Between idle and WOT, the engine vacuum drops as a function of how widely the throttle has been opened.

The inverse relationship between available engine vacuum and engine output power creates two inherent problems that are difficult to effectively overcome in the design of a positive crankcase ventilation system utilizing engine vacuum to provide a flow of air through the crankcase.

The first problem is that when the engine is operating unloaded, at idle, with the throttle nearly closed, the available engine vacuum is so large that an excessive volume of air may be drawn through the crankcase, and introduced to the intake manifold. The amount of air from the crankcase must be kept at a small enough percentage of the air entering the engine, so that the air from the crankcase with its entrained contaminants will not adversely affect the air/fuel ratio being supplied to the engine.

The second problem is that when the engine is operating at a maximum output power condition, with the throttle at or near WOT, there is not enough engine vacuum available to draw a large enough flow of air through the crankcase to provide effective crankcase ventilation.

In order to address these problems, a PCV system utilizing engine vacuum typically includes a PCV valve, located between the crankcase and the engine air intake, for controlling the flow of air that can be drawn through the crankcase by the engine vacuum. A typical PCV valve includes a spring-loaded poppet that is positioned within a flow-controlling bore of the PCV valve by the engine vacuum.

When the engine is idling, and engine vacuum is high, the PCV valve poppet is pulled toward the engine by the high vacuum, to a position in the PCV valve bore where the flow of air from the crankcase is restricted, to keep the flow of air from the crankcase at a low enough volume that the air-fuel mixture being supplied to the engine will not be significantly diluted. When the engine is operating at an intermediate level of output power, the throttle will be opened wider, and the engine vacuum will be weaker than it is at idle. This weaker engine vacuum allows the spring in the PCV valve to move the poppet to a position in the PCV valve bore where the engine vacuum can draw an increased flow of air through the crankcase via the PCV system to remove fumes from the crankcase.

As the throttle is opened further toward WOT, so that the engine can produce more output power, the engine vacuum continues to drop, and the spring in the PCV valve moves the poppet of the PCV valve to a wide-open position where the full engine vacuum available is applied to the crankcase by the PCV system. It is difficult, however, to design a PCV valve that will function effectively in controlling the flow of air through the crankcase at all engine operating conditions, due to the inverse nature relationship of available engine vacuum with respect to output power.

As will be understood from the preceding discussion, a PCV system using engine vacuum and a traditional PCV valve may provide inefficient and ineffective removal of blow-by gasses, fumes, vapors, and other potential air pollutants from the engine crankcase.

What is needed is an improved apparatus and method for providing positive crankcase ventilation for an engine, in a manner that provides a flow of air through the engine crankcase that is substantially directly proportional to engine speed.

In most multi-cylinder engines, the crankcase volume remains relatively constant as the pistons reciprocate. As one cylinder moves inward, and takes away crankcase volume, another piston is moving outward adding crankcase volume, so that the overall crankcase volume remains substantially constant. In single cylinder engines, and certain multi-cylinder configurations, however, the reciprocating motion of piston(s) causes a substantial cyclical variation in the crankcase volume for every rotation of the engine.

This invention recognizes that, in engines where the crankcase volume varies cyclically as the pistons reciprocate, the cyclical variation in crankcase volume can be utilized for providing positive crankcase ventilation. Utilizing the cyclical variation in crankcase volume, in accordance with the invention, provides a flow of air for positive crankcase ventilation that increases in direct proportion to engine speed, rather than undesirably decreasing in proportion to engine speed as was the case in prior PCV systems utilizing engine vacuum.

SUMMARY OF THE INVENTION

The invention provides a method and apparatus for providing positive crankcase ventilation, for the crankcase of an engine having one or more reciprocating pistons exposed on a bottom side thereof to the crankcase, in such a manner that the crankcase and bottom side of the one or more reciprocating pistons define a crankcase volume that varies cyclically with reciprocation of the one or more pistons. The method and apparatus utilize the cyclically variable volume of the crankcase, resulting from reciprocation of the one or more pistons, for generating a flow of air through the crankcase. The method and apparatus provide a flow of air through the crankcase that varies substantially in direct proportion to engine speed. The engine may be a four-stroke engine.

In one form of the invention an inlet control device and an outlet control device are attached to the crankcase, for controlling the flow of air through the crankcase. The inlet device allows a flow of air into the crankcase through the inlet device when the crankcase volume is increasing, and restricts flow out of the crankcase when the crankcase volume is decreasing. The outlet device allows a flow of air to escape from the crankcase through the outlet device when the crankcase volume is decreasing, and restricts flow in to the crankcase through the outlet control device when the crankcase volume is increasing. In some forms of the invention, both the inlet device and the outlet device may be utilized for sealing the crankcase volume against the entry or exit of air or other fluids, when the engine is not running.

The invention may take the form of an engine, including a crankcase and one or more reciprocating pistons exposed on a bottom side thereof to the crankcase, whereby the crankcase and bottom side of the one or more reciprocating pistons define a crankcase volume that varies cyclically with reciprocation of the one or more pistons, and further including a positive crankcase ventilation (PCV) apparatus comprising a crankcase air inlet, a crankcase air outlet, and a control element utilizing the cyclically varying crankcase volume resulting from reciprocation of the one or more pistons for generating a unidirectional flow of air through the crankcase from the crankcase air inlet to the crankcase air outlet.

An engine according to the invention may take the form of a V-twin engine, having a pair of connecting rods joined to a crankshaft, through a pair of connecting rod journals that are centered at a common throw radius from the crankshaft axis, and displaced from one another along the throw radius by an angular displacement equal to an included angle defined by axes of the cylinders, so that the pistons will reciprocate in unison, and each reach top dead center (TDC) and bottom dead center (BDC) in their respective cylinders at substantially the same time. A crankshaft counterweight and one or more balance shafts may also be provided for counterbalancing unbalance loads in the apparatus.

In one form of the invention, a V-twin engine having a crankshaft mounted in a crankcase for rotation about a crankshaft axis, includes a pair of cylinders, a pair of pistons, and a pair of connecting rods. Each cylinder, of the pair of cylinders, defines a cylinder axis orthogonally disposed with respect to the crankshaft axis. The cylinders are disposed in a V configuration with respect to one another, with the cylinder axes defining an included angle with respect to one another bisected by a central plane including the crankshaft axis. The pair of pistons are disposed, one in each cylinder, for reciprocating movement in the cylinders along the cylinder axes from a top dead center (TDC) position to a bottom dead center (BDC) position in the cylinders. The pair of connecting rods, one in each cylinder, operatively connects the pistons to the crankshaft in such a manner that the pistons will reach TDC and BDC in their respective cylinders at substantially the same time. The connecting rods are joined, at a crankshaft end thereof, to the crankshaft by a pair of connecting rod journals centered at a common throw radius from the crankshaft axis and angularly displaced from one another along the throw radius by an angular displacement equal to the included angle of the cylinder axes.

Ignition in the V-twin engine may be controlled in such a manner that the cylinders fire alternately on sequential rotations of the crankshaft when the piston in the firing cylinder is approximately at TDC, to thereby provide an even firing engine that fires at 360 degrees of crankshaft revolution.

A V-twin engine, according to the invention, may also include a crankshaft counterweight attached to the crankshaft for rotation therewith about the crankshaft axis, and a first balance shaft having a counterweight attached thereto, mounted within the crankcase for rotation about a first balance shaft axis, and operatively connected to the crankshaft to be rotated thereby about the first balance shaft axis. The first balance shaft may rotate in a direction opposite a direction of rotation of the crankshaft in a one-to-one (1:1) ratio of rotations of the first balance shaft with respect to rotations of the crankshaft. A second balance shaft may also be operatively connected to the crankshaft for rotation about a second balance shaft axis in unison with the first balance shaft in a direction opposite the direction of rotation of the crankshaft, in a one-to-one (1:1) ratio of rotations of the second balance shaft with respect to rotations of the crankshaft. The second balance shaft includes a second balance shaft counterweight attached thereto for rotation with the second balance shaft about the second balance shaft axis, in unison with the counterweight of the first balance shaft. A crankshaft counterweight sized for counterbalancing one half of the total unbalance load of the engine, may be used in combination with counterweights on the first and second balance shafts that are each sized for counterbalancing one quarter of the total unbalance load of the engine.

The foregoing and other features and advantages of the invention will become further apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Figure 1:
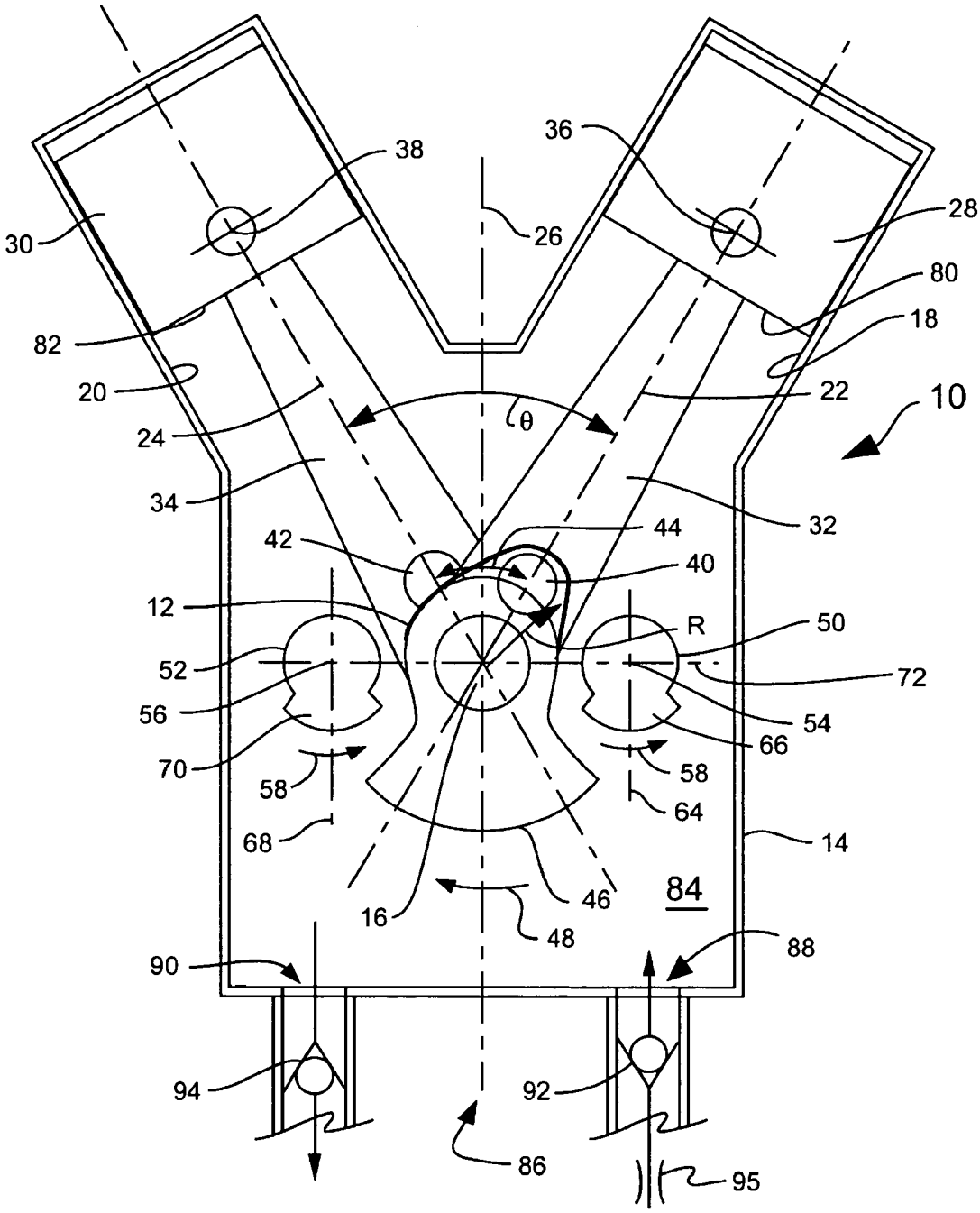
FIG. 1 is a schematic cross-section of an exemplary embodiment of V-twin engine, according to the invention, shown with both pistons located top dead center (TDC)

Throughout the following description of exemplary embodiments of the invention, components and features that are substantially equivalent or similar will be identified in the drawings by the same reference numerals. For the sake of brevity, once a particular element or function of the invention has been described in relation to one exemplary embodiment, the description and function will not be repeated for elements that are substantially equivalent or similar in form and/or function to the components previously described, in those instances where the alternate exemplary embodiments will be readily understood by those skilled in the art from a comparison of the drawings showing the various exemplary embodiments in light of the description of a previously presented embodiment.

DETAILED DESCRIPTION

FIG. 1 shows an exemplary embodiment of a V-twin engine 10, having a crankshaft 12 mounted in a crankcase 14 for rotation about a crankshaft axis 16. A pair of cylinders 18, 20, define respective cylinder axes 22, 24, which are orthogonally disposed with respect to the crankshaft axis 16. The cylinders 18, 20 are disposed in a V configuration, with respect to one another, with the cylinder axes 22, 24 defining an included angle θ with respect to one another. The included angle θ is bisected by a central plane 26, which includes the crankshaft axis 16.

Figure 2:
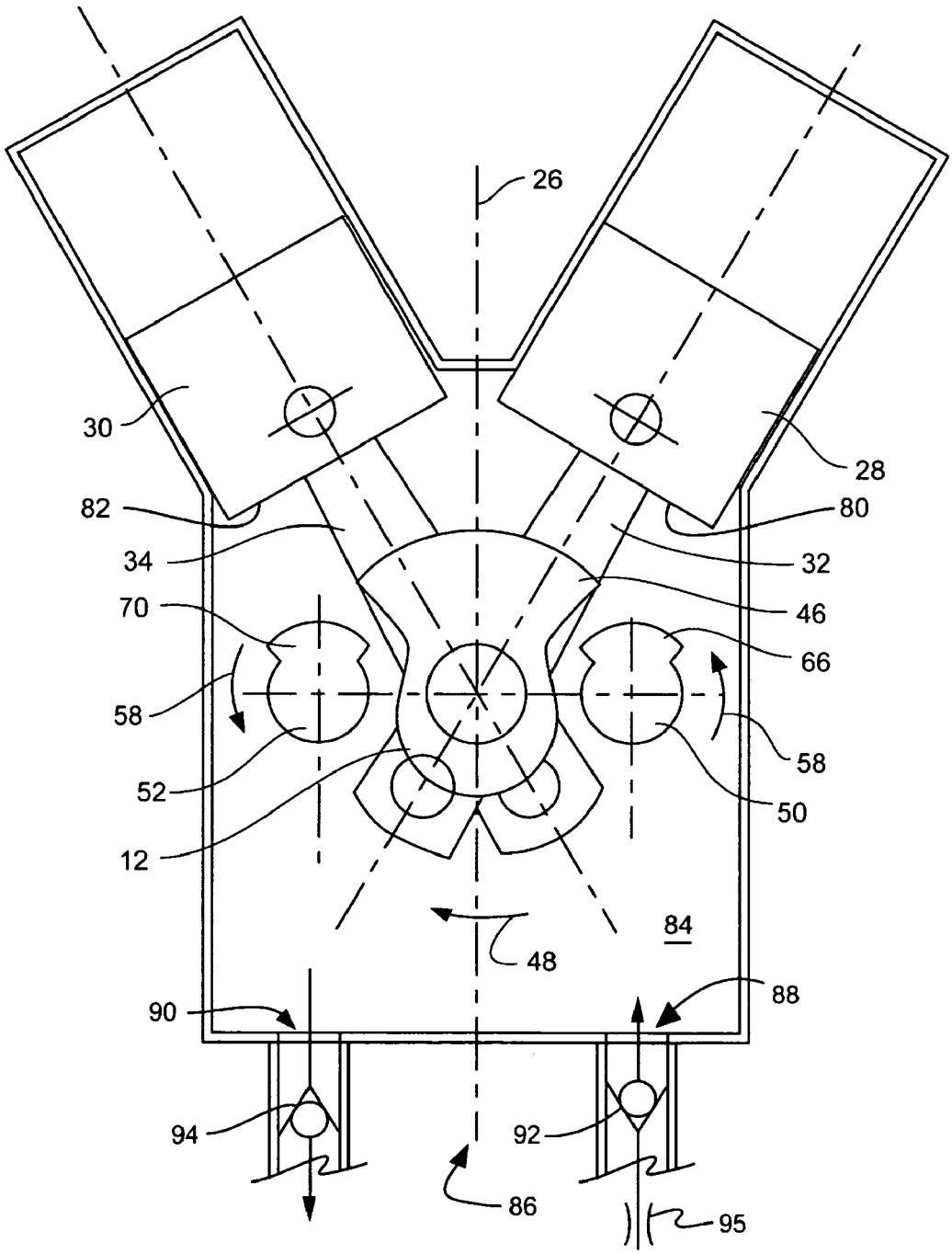
FIG. 2 is a schematic cross-section of the V-twin engine of FIG. 1, according to the invention, with both pistons located bottom dead center (BDC)

A pair of pistons 28, 30 are disposed, one in each cylinder 18, 20, for reciprocating movement in the cylinders 18, 20 along the cylinder axes 22, 24 from a top dead center (TDC) position in the cylinders 18, 20, as shown in FIG. 1, to a bottom dead center (BDC) position in the cylinders, as shown in FIG. 2.

A pair of connecting rods 32, 34, one in each cylinder 18, 20, operatively connect the pistons 28, 30 to the crankshaft 12, in such a manner that the pistons 28, 30 travel in unison and will reach TDC and BDC in their respective cylinders 18 at substantially the same time, as will be seen by examining FIGS. 1 and 2, and 4*a*–4*d*. The connecting rods 32, 34 are identical in length, and are joined to the pistons 28, 30 with conventional wrist pins 36, 38. The connecting rods 32, 34 are joined at a crankshaft end thereof to the crankshaft 16 by a pair of connecting rod journals 40, 42 centered at a common throw radius R from the crankshaft axis 16. The connecting rod journals 40, 42 are angularly displaced from one another along the throw radius by an angular displacement 44 that is equal to the length of an arc defined by the intersection of the throw radius R with the included angle θ of the cylinder axes 20, 22.

By virtue of this arrangement, the bottom surfaces 80, 82 of the pistons 28, 30, in conjunction with the crankcase 14, define a crankcase volume 84 that varies cyclically with reciprocation of the pistons 28, 30 in the cylinders 18, 20. Because the pistons 28, 30 reciprocate in unison, as will be appreciated from viewing FIGS. 1, 2, and 4*a*–4*e*, the cyclical variation in crankcase volume 84 is substantial, and can be used for pumping a flow of air through the crankcase 14 to provide positive crankcase ventilation, as described in more detail below.

The engine 10 includes a positive crankcase ventilation (PCV) apparatus 86 comprising a crankcase air inlet 88, a crankcase air outlet 90, and a control element comprising an inlet and an outlet control device 92, 94, to utilize the cyclically varying crankcase volume 84 resulting from reciprocation of the pistons 28, 30, for generating a unidirectional flow of air through the crankcase 14, from the crankcase air inlet 88 to the crankcase air outlet 90. The inlet and outlet control devices 92, 94 may take a variety of forms of unidirectional flow control devices known in the art, such as ball check valves, reed valves, duck-bill valves, umbrella valves, and reentrant orifices. Unidirectional flow control devices providing positive closure, such as spring loaded check valves, reed valves, duck-bill valves, and umbrella valves are preferred, so that the crankcase volume 84 will be sealed against the entry or exit of air or other fluids, when the engine 10 is not running, in order to meet government evaporative emissions regulations requiring that the crankcase volume 84 be sealed when the engine 10 is not running.

Figure 4A:
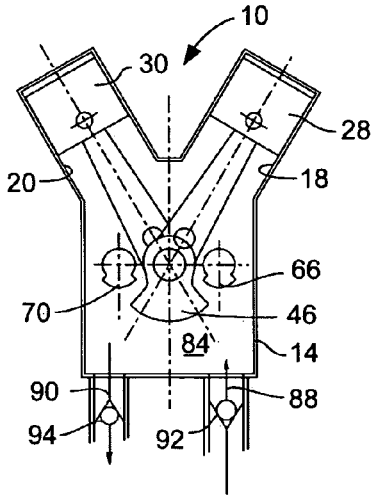
FIGS. 4*a*–4*e* are schematic cross section illustrations showing relative positions of internal components of the engine of FIGS. 1 and 2; and illustrating air flow through the crankcase of the engine as a function of cyclical variations in crankcase volume.
Figure 4B:
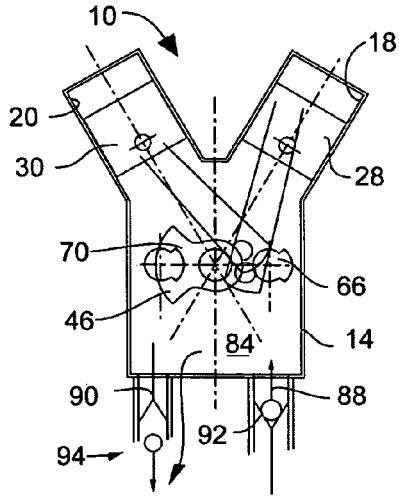
Figure 4C:
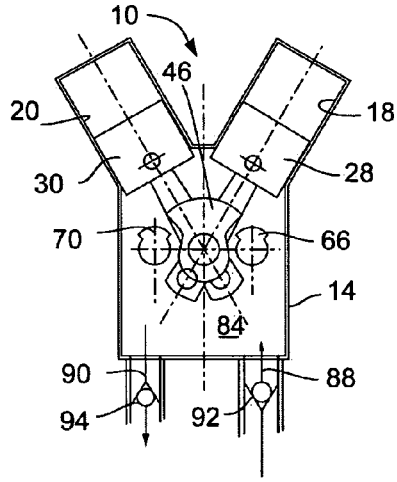
Figure 4D:
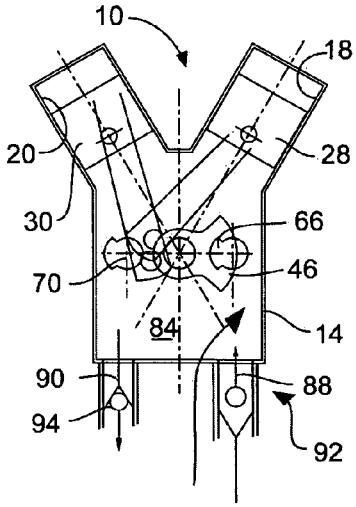

The inlet control device 92 is attached to the crankcase air inlet 88, for allowing a flow of air into the crankcase 14 through the inlet 88 when the crankcase volume 84 is increasing, as the pistons 28, 30 move from BDC to TDC, as shown in FIG. 4*d*, and for restricting flow out of the crankcase 14, as shown in FIG. 4*b*, when the crankcase volume 84 is decreasing as the pistons 28, 30 move from TDC to BDC. The outlet control device 94 is attached to the crankcase air outlet 90, for allowing a flow of air to escape from the crankcase 14 when the crankcase volume 84 is decreasing, as the pistons 28, 30 move from TDC to BDC, as shown in FIG. 4*b*, and for restricting flow in to the crankcase 14 when the crankcase volume 84 is increasing, as the pistons 28, 30 move from BDC to TDC, as shown in FIG. 4*d*. Whenever the crankcase volume 84 is not increasing or decreasing, such as when the engine is not running, both the inlet and outlet control devices 92, 94 are closed. At TDC and BDC both the inlet and outlet control devices 92, 94 are momentarily closed simultaneously.

The inventors have found that using the cyclically varying volume 84 of the crankcase for pumping air through the crankcase 14, according to the invention, may result in a flow of air through the crankcase 14 that is larger than desirable. The inlet and/or outlet control devices 92, 94 in the exemplary embodiment are sized to provide an internal restriction that will result in a desired flow of air through the crankcase 14. It may also be desirable, or necessary in some embodiments of the invention, to add a flow-controlling orifice, as shown at 95, to the inlet and/or outlet 88, 90 to limit the flow of air through the crankcase 14.

Figure 4E:
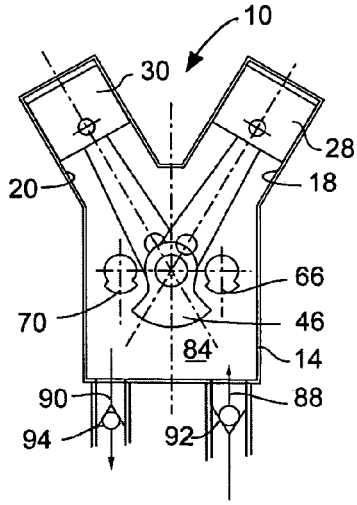

As shown in FIGS. 4*a*–4*e*, in each revolution of the crankshaft 12, the crankcase volume 84 will vary cyclically from a maximum volume condition when the pistons 28, 30 are at TDC, as shown in FIGS. 1, 4*a*, and 4*e*, to a minimum volume condition when the pistons 28, 30 are at BDC, as shown in FIGS. 2 and 4*c*. On each revolution of the engine 10, the crankcase volume 84 will undergo one complete cycle from the maximum volume condition to the minimum volume condition. Each complete revolution of the crankshaft 12 constitutes a complete cycle of crankcase volume 84, and a complete pumping stroke for pumping the flow of air in to and out of the crankcase 14. The flow of air pumped per minute, for example, will therefore be directly proportional the engine speed, i.e. the number revolutions per minute that the crankshaft 12 is turning. The unidirectional nature and relative orientation of the inlet and outlet control devices 92, 94, ensures a unidirectional flow of air through the crankcase 14.

The air flowing through the crankcase 14 may be provided to the crankcase inlet control device 92 from the ambient air surrounding the engine 10, or via a conduit (not shown) from an engine inlet air filter (not shown) in the same manner as prior PCV systems using engine vacuum to generate a flow of air through a crankcase. The flow of air exiting the crankcase 14 through the crankcase outlet device 94 may be ducted to an engine air intake (not shown) to be re-combusted, in the same manner as with prior PCV systems using engine vacuum for generating a flow of air through a crankcase.

The crankshaft 12 includes a crankshaft counterweight 46. The crankshaft counterweight 46 is fixedly attached to the crankshaft 12 at a point substantially diametrically opposite, with respect to the crankshaft axis 16, from the connecting rod journals 40, 42, as shown in FIG. 1. The crankshaft counterweight 46 rotates with the crankshaft 12 about the crankshaft axis 16, to thereby substantially center the counterweight 46 along the central plane 26 at a point opposite the pistons 28, 30, when the pistons 28, 30 are at TDC, as shown in FIG. 1, and along the central plane 26 at a point adjacent the pistons 28, 30, when the pistons 28, 30 are at BDC, as shown in FIG. 2.

As shown, in FIGS. 1 and 2, the crankshaft 12 defines a direction of rotation of the crankshaft, as indicated by arrow 48. A first and a second balance shaft 50, 52 are operatively connected to the crankshaft 12 for rotation respectively about a first and a second balance shaft axis 54, 56 in a direction, as shown by arrows 58, opposite the direction of rotation 48 of the crankshaft 12.

Figure 3B:
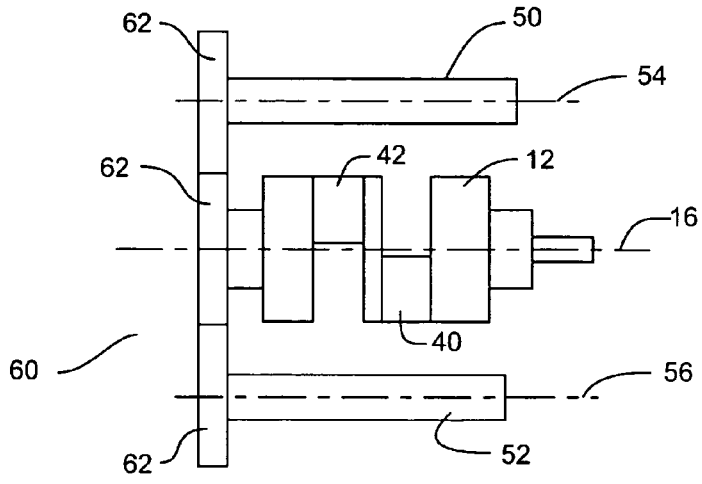
FIGS. 3*a* and 3*b* are schematic representations respectively of a crankshaft, and an exemplary embodiment of a gear train connecting the crankshaft to two balance shafts of the engine of FIGS. 1 and 2.
Figure 3A:
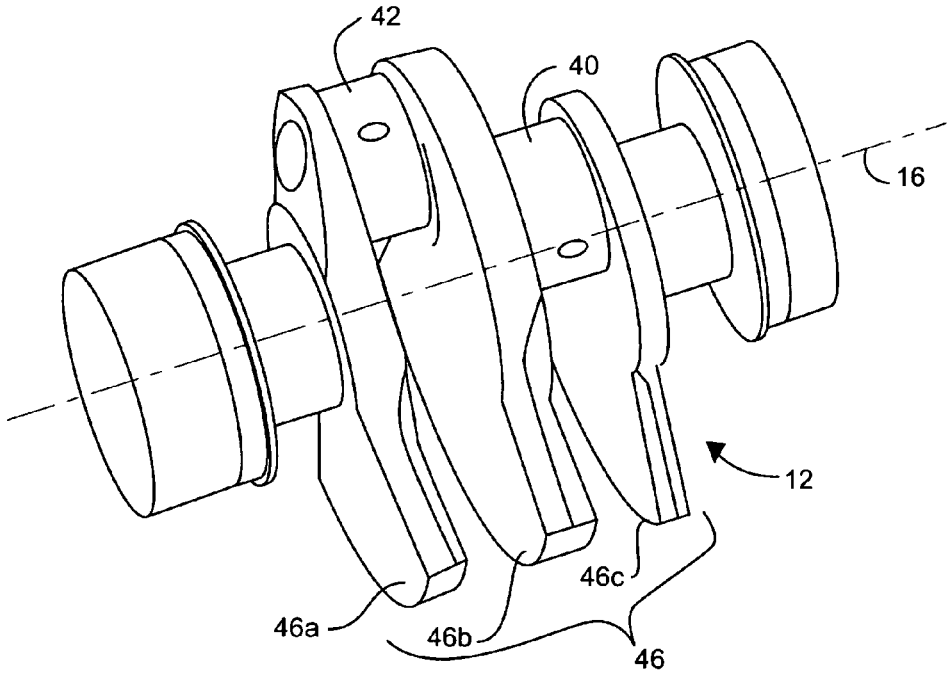

As shown in FIG. 3*a*, in the exemplary embodiment of the engine 10, the crankshaft counterweight 46 is split into three parts 46*a*, 46*b*, 46*c* positioned at either axial end and between the connecting rod journals 40, 42 of the crankshaft 12. In the cross sectional drawings of FIGS. 1, 2, and 4*a*–4*d*, the counterweight 46 is identified as a single part bearing the reference numeral 46. As shown in FIG. 3*b*, the first and second balance shafts 50, 52, in the exemplary embodiment of the engine 10, are operatively connected to the crankshaft 12 through a gear train 60, having three gears 62 of the same diameter, with one gear 62 attached to the crankshaft 12, and the other two gears 62 attached respectively to the first and second balance shafts 50, 52. By virtue of this drive arrangement, the first and second balance shafts 50, 52 rotate about their respective balance shaft axes 54, 56 in a one-to-one (1:1) ratio of rotations of the first and second balance shafts 50, 52 with respect to rotations of the crankshaft 12, but in a direction opposite a direction of rotation of the crankshaft 12. Those having skill in the art will recognize, however, that in other embodiments of the invention, it may be desirable to operatively connect the balance shafts 50, 52 to the crankshaft with other types of drive components or arrangements.

As shown in FIG. 1, the first balance shaft axis 54 is oriented in a direction parallel to the crankshaft axis 16 and lies in a first balance shaft plane 64 extending parallel to the central plane 26. The first balance shaft 50 further includes a first balance shaft counterweight 66 attached thereto for rotation with the first balance shaft 50 about the first balance shaft axis 54 from a first position at a point substantially opposite the cylinders 18, 20, along the first balance shaft plane 64 when the pistons 28, 30 are at TDC, as shown in FIG. 1, to a second point substantially adjacent the cylinders 18, 20 along the first balance shaft plane 64 when the pistons 28, 30 are at BDC, as shown in FIG. 2.

The second balance shaft axis 56 is oriented in a direction parallel to the crankshaft axis 16 and lying in a second balance shaft plane 68 extending parallel to the central plane 26. The second balance shaft 52 further includes a second balance shaft counterweight 70 attached thereto for rotation with the second balance shaft 52 about the second balance shaft axis 56 from a first position at a point substantially opposite the cylinders 18, 20, along the second balance shaft plane 68 when the pistons 28, 30 are at TDC, as shown in FIG. 1, to a second point substantially adjacent the cylinders 18, 20 along the second balance shaft plane 68 when the pistons 28, 30 are at BDC, as shown in FIG. 2.

In the exemplary embodiment of the engine 10, the first and second balance shaft axes 54, 56 and the crankshaft axis 16 lie in a common transverse plane 72 that orthogonally intersects the central plane 26. In other embodiments of the invention, however, it may be desirable to not have the balance shaft axes 54, 56 and the crankshaft axis 16 all lying in a common transverse plane.

In the exemplary embodiment of the engine 10, the total mass of the counterweight 46 on the crankshaft 12 is sized for counterbalancing one half of a total unbalance load of the engine 10, and the counterweights 66, 70 on the first and second balance shafts 50, 52 are each sized for counterbalancing one quarter of the total unbalance load of the engine 10. It may be desirable in other embodiments of the invention to utilize fewer or more balance shafts than the two utilized in the exemplary embodiment of the engine 10.

The engine 10, of the exemplary embodiment, is a four-stroke engine, in which the pair of cylinders 18, 20 fire alternately on sequential rotations of the crankshaft 12, when the piston in the firing cylinder is approximately at TDC. This arrangement results in the engine 10 firing once for every 360 degrees of rotation of the crankshaft 12.

Having the engine fire every 360° provides an engine that runs considerably quieter than V-twin engines that fire at other intervals. For example, a V-twin engine having the cylinders spaced at 90°, with a single crank pin for both connecting rods can be balanced, but will fire at uneven alternate intervals of 270 and 450 crank degrees, because both connecting rods are connected to the same crank pin. Similarly, a V-twin engine having the cylinders spaced at 60°, with a single crank pin for both connecting rods can also be balanced, but fires at uneven alternate intervals of 300 and 420 crank degrees, because both connecting rods are connected to the same crank pin. Firing at such uneven intervals generates noise and vibration that are undesirable in some environments, such as in automotive applications.

The V-twin engine 10, of the invention, fires at even intervals of 360° to produce a more acceptable sound and vibration profile for an automotive environment. This occurs because the connecting rods 32, 34 in a V-twin engine 10 according to the present invention are connected to separate crank pins (i.e. connecting rod journals 40, 42) in such a manner that the pistons 28, 30 simultaneously reach TDC.

FIGS. 4*a*–4*e* sequentially show the motion of the internal components, described above, during a single rotation of the crankshaft 12 of the engine 10. FIGS. 4*a* and 4*e* show the engine 10 with the pistons 28, 30 at TDC, as shown and described in more detail above with respect to FIG. 1. FIG. 4*c* shows the engine 10 with the pistons 28, 30 at BDC, as shown and described in more detail above with respect to FIG. 2.

For purposes of explanation, it will be assumed that in FIG. 4*a* the left cylinder 20 (as shown in the FIGS.) is firing with the piston 30 at approximately TDC. It will be understood that the term approximately at TDC is intended to communicate that ignition in the cylinder 30 may be timed to occur at an appropriate point in a range of angular positions of the crankshaft 12, from several degrees before to several degrees after the piston 30 actually reaches TDC, as is known in the art.

With the left cylinder 30 firing, and beginning its power stroke, as shown in FIG. 4*a*, the right cylinder 28 has just completed its exhaust stroke, and is beginning its intake stroke. The crankshaft counterweight 46, and the first and second balance shaft counterweights 66, 70, are all oriented opposite the pistons 28, 30 to thereby counter vertical forces of the reciprocating components.

FIG. 4*b* shows the engine 10 components ¼ of the way through the crankshaft rotation, with the left piston 30 being forced downward on its power stroke, to thereby turn the crankshaft 12, and the right piston 28 drawing air into the right cylinder 18 on its intake stroke. Because the crankshaft 12 and the first and second balance shafts 50, 52 rotate in opposite directions, in a 1:1 rotation ratio, as described above, the first and second counterweights 66, 70 are positioned diametrically opposite the crankshaft counterweight 46, in the position shown in FIG. 4*b*, for counterbalancing internal unbalance forces in the engine 10.

FIG. 4*c* shows the engine 10 components ½ of the way through the crankshaft rotation, at BDC, with the left piston 30 having just completed its power stroke and beginning its exhaust stroke, and the right piston 28 having just completed its intake stroke and starting its compression stroke. At BDC, the crankshaft counterweight 46 and the first and second balance shaft counterweights 66, 70 are all aligned adjacent the pistons 28, 30 to counter vertical forces generated by the downward motion of the internal components during the first half of the engine rotation.

FIG. 4*d* shows the engine 10 components 3/4 of the way through the crankshaft rotation, at BDC, with the left piston 30 halfway through its exhaust stroke, and the right piston 28 halfway through its compression stroke. Because the crankshaft 12 and the first and second balance shafts 50, 52 rotate in opposite directions, in a 1:1 rotation ratio, as described above, the first and second balance shaft counterweights 66, 70 are again positioned diametrically opposite the crankshaft counterweight 46, in the position shown in FIG. 4*d*, for counterbalancing internal unbalance forces in the engine 10.

When the crankshaft 12 has traveled another 1/4 of a rotation, the pistons 28, 30 will once again be at TDC, as shown in FIG. 4*e*, with the left piston having just completed its exhaust stroke and beginning its intake stroke, and the right piston 28 having just completed its compression stroke. The right cylinder 18 will fire at approximately TDC, and the cycle described above will be repeated for the next rotation of crankshaft 12, with the right piston 28 completing its power and exhaust stroke, and the left piston 30 completing its intake and compression strokes during the second rotation of the crankshaft 12. This alternating cycle continues as long as the engine 10 is running, with the cylinders 18, 20 firing alternately on sequential rotations of the crankshaft 12.

Those skilled in the art will also readily recognize that, while the embodiments of the invention disclosed herein are presently considered to be preferred, various changes and modifications can be made without departing from the spirit and scope of the invention. For example, the invention can be used in other types of engines having variable crankcase volumes, such as single cylinder, multi-cylinder, or V-twin engines of configurations other than the even firing V-twin engine disclosed herein.

The scope of the invention is indicated in the appended claims, and all changes or modifications within the meaning and range of equivalents are intended to be embraced therein.

We claim:

1. A method for providing positive crankcase ventilation for the crankcase of a four-stroke engine having one or more reciprocating pistons exposed on a bottom side thereof to the crankcase, whereby the crankcase and bottom side of the one or more reciprocating pistons define a crankcase volume that varies cyclically with reciprocation of the one or more pistons, the method comprising:

utilizing the cyclically varying volume of the crankcase resulting from reciprocation of the one or more pistons for generating a flow of air through the crankcase;

varying the flow of air through the crankcase substantially in direct proportion to engine speed;

attaching an inlet control device to the crankcase for allowing a flow of air into the crankcase through the inlet device when the crankcase volume is increasing, and restricting flow out of the crankcase when the crankcase volume is decreasing; and attaching an outlet control device to the crankcase for allowing a flow of air to escape from the crankcase through the outlet device when the crankcase volume is decreasing, and restricting flow in to the crankcase through the outlet control device when the crankcase volume is increasing.

2. The method of claim 1 further comprising closing both the inlet device and the outlet control devices when the engine is not running, to thereby seal the crankcase volume against the entry or exit of air or other fluids.

3. An apparatus further for providing positive crankcase ventilation for the crankcase of a four-stroke engine having one or more reciprocating pistons exposed on a bottom side thereof to the crankcase, whereby the crankcase and bottom side of the one or more reciprocating pistons define a crankcase volume that varies cyclically with reciprocation of the one or more pistons, the apparatus comprising:

a crankcase air inlet, a crankcase air outlet, and a control element utilizing the cyclically varying crankcase volume resulting from reciprocation of the one or more pistons for generating a unidirectional flow of air through the crankcase from the crankcase air inlet to the crankcase air outlet, wherein the apparatus varies the flow of air through the crankcase substantially in direct proportion to engine speed;

an inlet control device attached to the crankcase air inlet for allowing a flow of air into the crankcase through the when the crankcase volume is increasing, and restricting flow out of the crankcase when the crankcase volume is decreasing; and an outlet control device to the crankcase air outlet for allowing a flow of air to escape from the crankcase when the crankcase volume is decreasing, and restricting flow in to the crankcase through the outlet control device when the crankcase volume is increasing.

4. The apparatus of claim 3, wherein both the inlet device and the outlet device seal the crankcase volume against the entry or exit of air or other fluids, when the engine is not running.

5. A four-stroke engine comprising:

a crankcase and one or more reciprocating pistons exposed on a bottom side thereof to the crankcase, whereby the crankcase and bottom side of the one or more reciprocating pistons define a crankcase volume that varies cyclically with reciprocation of the one or more pistons; and a positive crankcase ventilation (PCV) apparatus including:

a crankcase air inlet;

a crankcase air outlet; and a control element having an inlet control device attached to the crankcase air inlet for allowing a flow of air into the crankcase through the when the crankcase volume is increasing, and restricting flow out of the crankcase when the crankcase volume is decreasing, and an outlet control device attached to the crankcase air outlet for allowing a flow of air to escape from the crankcase when the crankcase volume is decreasing, and restricting flow in to the crankcase through the outlet control device when the crankcase volume is increasing, wherein the control element utilizes the cyclically varying crankcase volume resulting from reciprocation of the one or more pistons for generating a unidirectional flow of air through the crankcase from the crankcase air inlet to the crankcase air outlet, and wherein the PCV apparatus varies the flow of air through the crankcase substantially in direct proportion to engine speed.

6. The engine of claim 5, wherein both the inlet device and the outlet device seal the crankcase volume against the entry or exit of air or other fluids, when the engine is not running.

7. The engine of claim 6, wherein the engine is a V-twin engine comprising:

a crankshaft mounted in an engine block for rotation about a crankshaft axis;

a pair of cylinders, each defining a cylinder axis orthogonally disposed with respect to the crankshaft axis, the cylinders disposed in a V configuration with respect to one another, with the cylinder axes defining an included angle with respect to one another bisected by a central plane including the crankshaft axis;

a pair of pistons disposed, one in each cylinder, for reciprocating movement in the cylinders along the cylinder axes from a top dead center (TDC) position to a bottom dead center (BDC) position in the cylinders;

a pair of connecting rods, one in each cylinder, for operatively connecting the pistons to the crankshaft such that the pistons will reach TDC and BDC in their respective cylinders at substantially the same time; and the connecting rods joined at a crankshaft end thereof to the crankshaft by a pair of connecting rod journals centered at a common throw radius from the crankshaft axis and angularly displaced from one another along the throw radius by an angular displacement equal to the included angle of the cylinder axes.

8. The engine of claim 7, wherein the V-twin engine is a four-stroke engine.

9. The engine of claim 8, wherein the pair of cylinders fire alternately on sequential rotations of the crankshaft when the piston in the firing cylinder is approximately at TDC.

10. The engine of claim 7, further comprising:

a crankshaft counterweight attached to the crankshaft for rotation therewith about the crankshaft axis; and a first balance shaft having a counterweight attached thereto, mounted within the engine block for rotation about a first balance shaft axis, and operatively connected to the crankshaft to be rotated thereby about the first balance shaft axis.

11. The engine of claim 10, wherein the first balance shaft rotates in a direction opposite a direction of rotation of the crankshaft in a one-to-one (1:1) ratio of rotations of the first balance shaft with respect to rotations of the crankshaft.

12. The engine of claim 11, further comprising:

a second balance shaft operatively connected to the crankshaft for rotation about a second balance shaft axis in unison with the first balance shaft in a direction opposite the direction of rotation of the crankshaft in a one-to-one (1:1) ratio of rotations of the second balance shaft with respect to rotations of the crankshaft;

the second balance shaft further comprising a second balance shaft counterweight attached thereto for rotation with the second balance shaft about the second balance shaft axis, in unison with the counterweight of the first balance shaft.

13. The engine of claim 12, wherein the unbalance load is a total unbalance load of the engine, the crankshaft counterweight is sized for counterbalancing one half of the total unbalance load of the engine, and the counterweights on the first and second balance shafts are each sized for counterbalancing one quarter of the total unbalance load of the engine.

* * * * *